US010184216B2

(12) United States Patent
Urbanek et al.

(10) Patent No.: US 10,184,216 B2
(45) Date of Patent: Jan. 22, 2019

(54) ADVANTAGEOUS DETECTABLE WARNING AREA AND METHODS OF FORMING THE SAME

(71) Applicants: Thomas Urbanek, Fort Pierce, FL (US); Robert Urbanek, Fort Pierce, FL (US); James Urbanek, Fort Pierce, FL (US)

(72) Inventors: Thomas Urbanek, Fort Pierce, FL (US); Robert Urbanek, Fort Pierce, FL (US); James Urbanek, Fort Pierce, FL (US)

( * ) Notice: Subject to any disclaimer, the term of this patent is extended or adjusted under 35 U.S.C. 154(b) by 0 days.

(21) Appl. No.: 13/727,756

(22) Filed: Dec. 27, 2012

(65) Prior Publication Data

US 2014/0023435 A1 Jan. 23, 2014

Related U.S. Application Data

(60) Provisional application No. 61/672,952, filed on Jul. 18, 2012.

(51) Int. Cl.
*E01C 9/00* (2006.01)
*E01C 19/12* (2006.01)
*A61H 3/06* (2006.01)

(52) U.S. Cl.
CPC ..... *E01C 9/001* (2013.01); *A61H 3/066* (2013.01); *E01C 19/12* (2013.01)

(58) Field of Classification Search
USPC ..... 404/9, 19, 75
See application file for complete search history.

(56) References Cited

U.S. PATENT DOCUMENTS

| | | | | |
|---|---|---|---|---|
| 2,115,667 | A * | 4/1938 | Ellis | 404/70 |
| 5,827,009 | A * | 10/1998 | Kokoletsos | 404/75 |
| 6,499,910 | B1 * | 12/2002 | Grahmbeek | A61H 3/066 404/72 |
| 7,234,893 | B2 * | 6/2007 | Lyons | 404/72 |
| 7,799,379 | B2 * | 9/2010 | Julnes | 427/272 |
| 8,028,491 | B2 * | 10/2011 | Flaherty et al. | 52/747.11 |
| 2004/0072964 | A1 * | 4/2004 | Udding | C08G 18/6715 525/453 |
| 2006/0198698 | A1 * | 9/2006 | Hall et al. | 404/75 |
| 2007/0249862 | A1 * | 10/2007 | Nagy et al. | 562/590 |
| 2009/0169297 | A1 * | 7/2009 | Koehn | 404/9 |
| 2012/0184681 | A1 * | 7/2012 | Hibben | 525/274 |
| 2013/0172486 | A1 * | 7/2013 | Hibben | C08F 230/08 525/100 |

* cited by examiner

*Primary Examiner* — Thomas B Will
*Assistant Examiner* — Katherine J Chu
(74) *Attorney, Agent, or Firm* — Sughrue Mion, PLLC

(57) ABSTRACT

Detectable warning areas (DWAs) and methods of forming the same are provided. A mat template having one or more holes can be placed over a substrate, and a dome-forming material can be filled in the mat template by pouring the dome-forming material over the mat template and working the dome-forming material into the one or more holes of the mat template. The mat template can remain in place until the dome-forming material is completely cured, and then the mat template can be removed. DWAs formed according to this method display improved properties, including increased bond strength.

17 Claims, 4 Drawing Sheets

ADVANTAGEOUS DETECTABLE WARNING AREA AND METHODS OF FORMING THE SAME

CROSS-REFERENCE TO RELATED APPLICATION

This application claims the benefit of U.S. provisional application Ser. No. 61/672,952, filed Jul. 18, 2012, which is herein incorporated by reference in its entirety.

BACKGROUND OF THE INVENTION

Detectable warning areas (DWAs) are integral surface features built in or applied to walking surfaces or other elements to warn individuals with visual impairments of hazards on a circulation path. DWAs are often standardized and typically include raised features, such as domes. DWAs are generally found along a sidewalk, near a curb, before a road or door at an airport or train station, or along other circulation paths.

Truncated domes are a uniform standard that have been chosen by the federal government over all others as the only approved surface texture allowed under specified criteria such that "continuity" of design for the visually impaired is maintained. According to the Americans with Disabilities Act Accessibility Guidelines (ADAAG), truncated domes are to be placed around hazardous vehicular ways, access ramps, transit platform edges, and where predetermined edge protection is required.

Existing methods to form DWAs include using an epoxy-based dome material in a relatively rigid, re-usable template made of hard rubber. The dome material is applied to the template using a squeeze bottle, and then the template is removed almost immediately and the dome material is allowed to cure after the template is removed. While curing, the dome material can rise, such that it no longer takes the same shape as the template.

BRIEF SUMMARY OF THE INVENTION

Embodiments of the subject invention relate to detectable warning areas (DWAs), methods of forming DWAs, and kits for forming DWAs. A DWA of the subject invention can include one or more domes. Any or all of the domes of the DWA can be a truncated dome.

In an embodiment, a method of forming a DWA having a plurality of domes can include: forming a substrate; placing a mat template on the substrate; filling the mat template with a dome-forming material by pouring the dome-forming material over the mat template and working the dome-forming material into the plurality of holes of the mat template; allowing the dome-forming material to completely cure; and removing the mat template after the dome-forming material has completely cured, thereby forming the plurality of domes, each dome of the plurality of domes corresponding to a hole of the plurality of holes of the mat template. The mat template can include a plurality of holes, and the dome-forming material can be an acrylic-based dome-forming material.

In another embodiment, a DWA can be formed by a method as described herein. The DWA can have a bond strength of at least 900 pounds per square inch, a dry coefficient of slip resistance of at least 0.90, and a water absorption of less than or equal to 0.8%.

In yet another embodiment, a kit can include: at least one container of acrylic-based dome-forming material; at least one container of gelcoat substrate material; at least one packet of peroxide catalyst; and at least one mat template having a plurality of holes.

DETAILED DISCLOSURE OF THE INVENTION

When the terms "on" or "over" are used herein, when referring to layers, regions, patterns, or structures, it is understood that the layer, region, pattern or structure can be directly on another layer or structure, or intervening layers, regions, patterns, or structures may also be present. When the terms "under" or "below" are used herein, when referring to layers, regions, patterns, or structures, it is understood that the layer, region, pattern or structure can be directly under the other layer or structure, or intervening layers, regions, patterns, or structures may also be present. When the term "directly on" is used herein, when referring to layers, regions, patterns, or structures, it is understood that the layer, region, pattern or structure is directly on another layer or structure, such that no intervening layers, regions, patterns, or structures are present. When the term "direct contact" is used herein, when referring to layers, regions, patterns, or structures in contact with other layers, regions, patterns, or structures, it is understood that the layer, region, pattern or structure is in direct, physical contact with the other layer, region, pattern, or structure, such that no intervening layers, regions, patterns, or structures are present.

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

Figure 6:
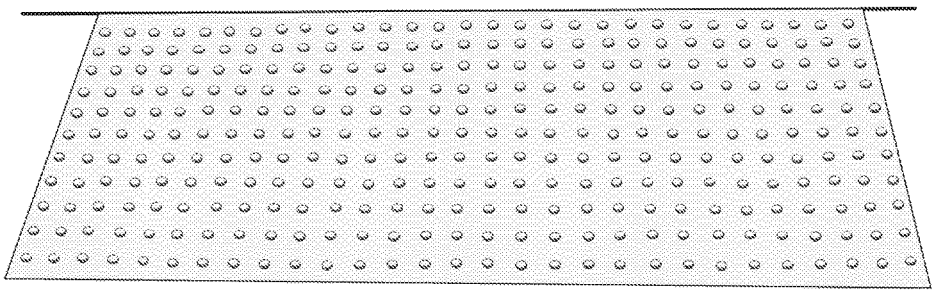
FIG. 6 shows a top view image of a detectable warning area (DWA) according to an embodiment of the subject invention.
Figures 7A, 7B:
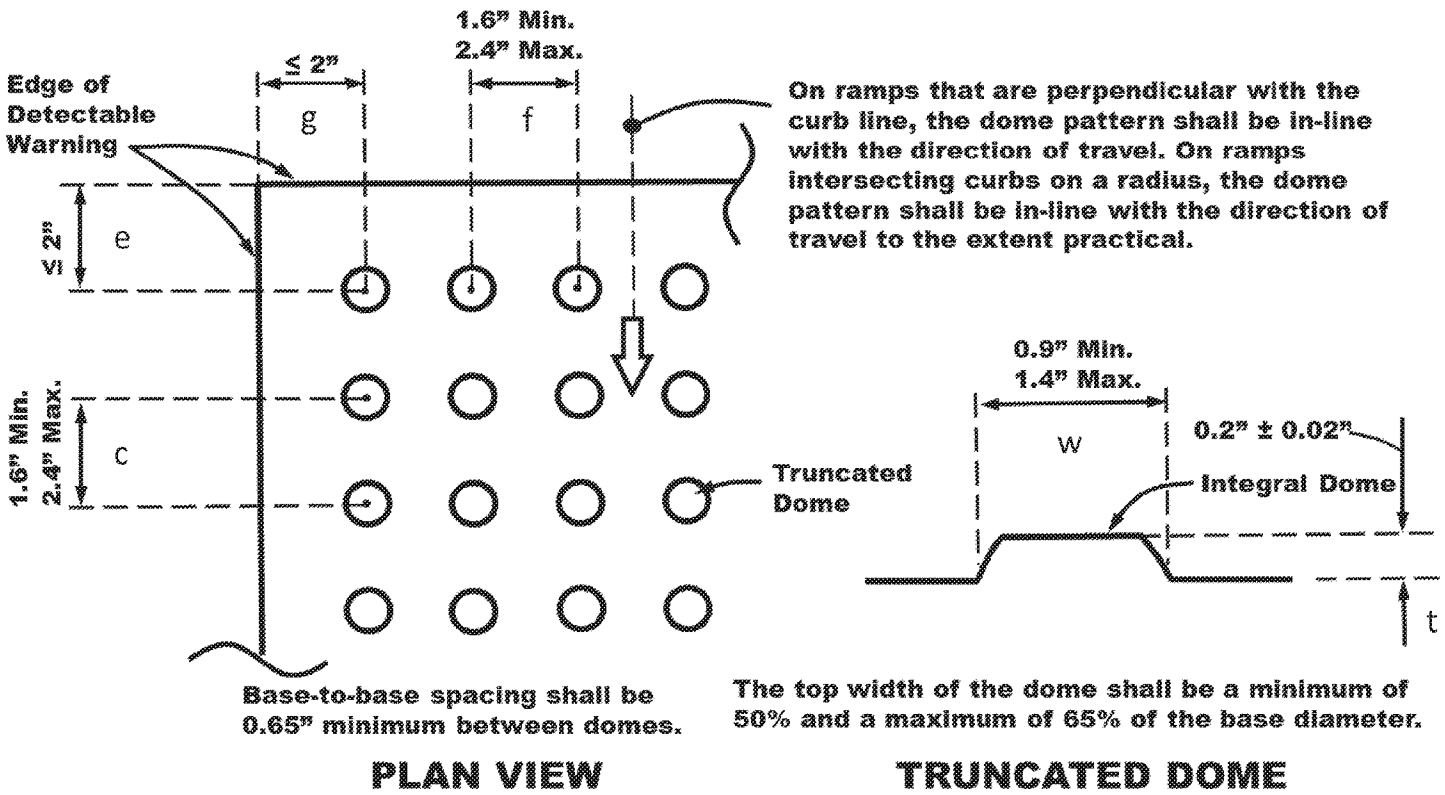
FIG. 7A shows a plan view of a mat used for making truncated domes according to an embodiment of the subject invention.
FIG. 7B shows a side view of a truncated dome according to an embodiment of the subject invention.

Embodiments of the subject invention relate to detectable warning areas (DWAs), methods of forming DWAs, and kits for forming DWAs. A DWA of the subject invention can include one or more domes, as seen in, for example. FIG. 6. Any or all of the domes of the DWA can be a truncated dome. As used herein, the term "truncated dome" means that the base of the dome attached to the substrate is wider than the top portion of the dome. The truncated dome can have a slightly curved outer edge as seen in FIG. 7B, though embodiments are not limited thereto.

In an embodiment, a method of forming a DWA can include forming a substrate, placing a mat template on the substrate, filling the mat template with dome-forming material, and removing the mat template. The mat template can include one or more holes in which the dome(s) can be formed. Filling the mat template with dome-forming material can include pouring the dome-filing material over the mat template and working the dome-forming material into the one or more holes.

In a particular embodiment, the dome-forming material can be worked into the one or more holes of the mat template using a tool, such as a squeegee. The squeegee can include a handle and a fiat portion. The fiat portion can be, for example, a pliable material such as rubber or plastic, though embodiments are not limited thereto. The fiat portion can have a length of, for example, any of the following values or within any range having any of the following values as endpoints, though embodiments are not limited thereto: 1 inch (in), about 1 in, 2 in, about 2 in, 3 in, about 3 in, 4 in, about 4 in, 5 in, about 5 in, 6 in, about 6 in, 7 in, about 7 in, 8 in, about 8 in, 9 in, about 9 in, 10 in, about 10 in, 11 in, about 11 in, 12 in, about 12 in, 13 in, about 13 in, 14 in, about 14 in, 15 in, about 15 in, 16 in, about 16 in, 17 in, about 17 in, 18 in, about 18 in, 19 in, about 19 in, 20 in, about 20 in, 21 in, about 21 in, 22 in, about 22 in, 23 in, about 23 in, 24 in, about 24 in, less than 1 in, or greater than 24 in. The use of a squeegee can advantageously push down on the mat template to help get the dome-forming material into the holes of the mat template. In an embodiment, the squeegee can be disposable, such that each time a DWA is formed, a new squeegee is used.

In many embodiments, the dome-forming material is allowed to completely cure before the mat template is removed. That is, the dome-forming material cures completely within the mat template, ensuring that the final domes take the desired shape represented by the mat template. Undeveloped domes may be formed by removing the mat template too early (e.g., before the dome-forming material cures). After filling the mat template with dome-forming material (e.g., after working the dome-forming material into one or more holes of the mat template), the dome-forming material can take, for example, about 5 minutes to cure. The amount of time the dome-forming material should be allowed to remain in the mat template in order for it to completely cure can be, for example, any of the following values or within any range having any of the following values as endpoints, though embodiments are not limited thereto: 2 minutes (min), about 2 min, 3 min, about 3 min, 3.5 min, about 3.5 min, 4 min, about 4 min, 4.5 min, about 4.5 min, 5 min, about 5 min, 5.5 min, about 5.5 min, 6 min, about 6 min, 6.5 min, about 6.5 min, 7 min, about 7 min, 8 min, about 8 min, 9 min, about 9 min, 10 min, about 10 min, 11 min, about 11 min, 12 min, about 12 min, 13 min, about 13 min, 14 min, about 14 min, 15 min, about 15 min, 16 min, about 16 min, 17 min, about 17 min, 18 min, about 18 min, 19 min, about 19 min, 20 min, about 20 min, 21 min, about 21 min, 22 min, about 22 min, 23 min, about 23 min, 24 min, about 24 min, 25 min, about 25 min, 26 min, about 26 min, 27 min, about 27 min, 28 min, about 28 min, 29 min, about 29 min, 30 min, about 30 min, or greater than 30 min. For example, the amount of time the dome-forming material should be allowed to remain in the mat template in order for it to completely cure can be in the range of from 1 min to 5 min, from 4 min to 5 min, from 4 min to 6 min, from about 1 min to about 5 min, from about 1 min to about 6 min, from about 4 min to about 5 min, or from about 4 min to about 6 min.

Figure 1:
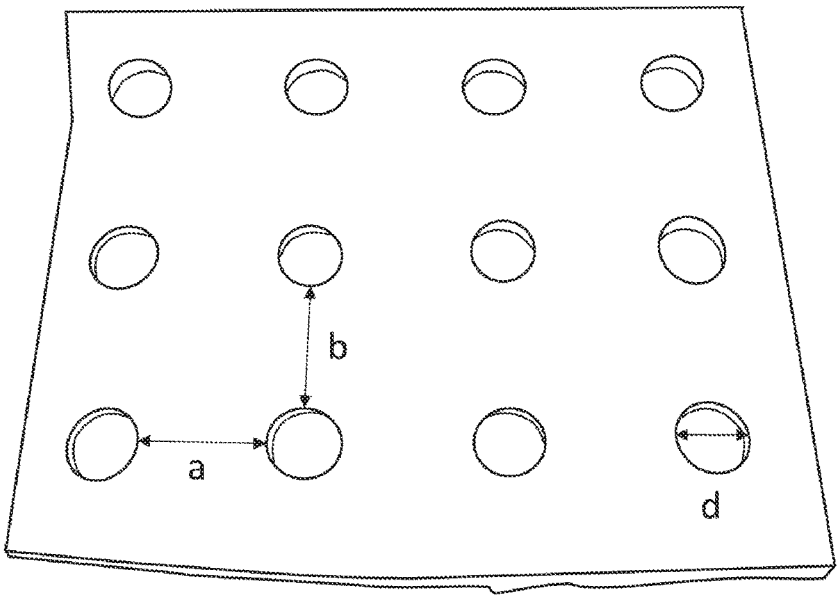
FIG. 1 shows a top view image of a mat template according to an embodiment of the subject invention.

FIG. 1 shows a top view of a portion of a mat template that can be used to form a DWA according to the subject invention. The mat template can be made larger or smaller in any direction, depending on the desired size of the DWA and/or the domes. That is, the mat template can be made to have a larger or smaller width, length, and/or thickness. Referring to FIG. 1, the mat template can include one or more holes in which domes can be formed by dome-forming material. Any or all of the holes in the mat template can have a circular cross-section. The holes can be provided in a regular pattern. For example, the holes can be provided in an array such that the outer holes form a rectangular shape and such that holes along any axis that is parallel to a side of the rectangular shape are the same distance apart from each other. This arrangement can be seen in FIGS. 1 and 7A. For example, the length a in FIG. 1 can be the same between all holes along that axis, and the length b can be the same between all holes along that axis. In certain embodiments, the length a can be equal to the length b. The width or diameter d of the holes can vary or all holes can have the same width.

FIG. 7A shows a plan view of a mat template used for making truncated domes according to an embodiment of the subject invention, and FIG. 7B shows a side view of a truncated dome according to an embodiment of the subject invention. The mat template can be made of any reasonable size (length, width, and thickness) and the holes can have any spacing and diameter, depending on the desired size and layout of the DWA. The distances c,f between center points of adjacent holes can each be, for example, any of the following values or within any range having any of the following values as endpoints, though embodiments are not limited thereto: 0.5 in, about 0.5 in, 0.6 in, about 0.6 in, 0.7 in, about 0.7 in, 0.8 in, about 0.8 in, 0.9 in, about 0.9 in, 1.0 in, about 1.0 in, 1.1 in, about 1.1 in, 1.2 in, about 1.2 in, 1.3 in, about 1.3 in, 1.4 in, about 1.4 in, 1.5 in, about 1.5 in, 1.6 in, about 1.6 in, 1.7 in, about 1.7 in, 1.8 in, about 1.8 in, 1.9 in, about 1.9 in, 2.0 in, about 2.0 in, 2.1 in, about 2.1 in, 2.2 in, about 2.2 in, 2.3 in, about 2.3 in, 2.4 in, about 2.4 in, 2.5 in, about 2.5 in, 2.6 in, about 2.6 in, 2.7 in, about 2.7 in, 2.8 in, about 2.8 in, 2.9 in, about 2.9 in, 3.0 in, about 3.0 in, 3.1 in, about 3.1 in, 3.2 in, about 3.2 in, 3.3 in, about 3.3 in, 3.4 in, about 3.4 in, 3.5 in, about 3.5 in, 3.6 in, about 3.6 in, 3.7 in, about 3.7 in, 3.8 in, about 3.8 in, 3.9 in, about 3.9 in, 4.0 in, about 4.0 in, less than 0.5 in, or greater than 4.0 in. For example, the distances c,f between center points of adjacent holes can each be in a range of from 1.6 in to 2.4 in or from about 1.6 in to about 2.4 in. In an embodiment, the distances c and f can be the same.

The width w of the dome and therefore the diameter d of the hole (see also FIG. 1) can be, for example, any of the following values or within any range having any of the following values as endpoints, though embodiments are not limited thereto: 0.1 in, about 0.1 in, 0.2 in, about 0.2 in, 0.3 in, about 0.3 in, 0.4 in, about 0.4 in, 0.5 in, about 0.5 in, 0.6 in, about 0.6 in, 0.7 in, about 0.7 in, 0.8 in, about 0.8 in, 0.9 in, about 0.9 in, 1.0 in, about 1.0 in, 1.1 in, about 1.1 in, 1.2 in, about 1.2 in, 1.3 in, about 1.3 in, 1.4 in, about 1.4 in, 1.5 in, about 1.5 in, 1.6 in, about 1.6 in, 1.7 in, about 1.7 in, 1.8 in, about 1.8 in, 1.9 in, about 1.9 in, 2.0 in, about 2.0 in, 2.1 in, about 2.1 in, 2.2 in, about 2.2 in, 2.3 in, about 2.3 in, 2.4 in, about 2.4 in, 2.5 in, about 2.5 in, 2.6 in, about 2.6 in, 2.7 in, about 2.7 in, 2.8 in, about 2.8 in, 2.9 in, about 2.9 in, 3.0 in, about 3.0 in, 3.1 in, about 3.1 in, 3.2 in, about 3.2 in, 3.3 in, about 3.3 in, 3.4 in, about 3.4 in, 3.5 in, about 3.5 in, 3.6 in, about 3.6 in, 3.7 in, about 3.7 in, 3.8 in, about 3.8 in, 3.9 in, about 3.9 in, 4.0 in, about 4.0 in, less than 0.1 in, or greater than 4.0 in. For example, the width w of the dome and therefore the diameter d of the hole can be in a range of from 0.9 in to 1.4 in or from about 0.9 in to about 1.4 in.

The dome can be a truncated dome. The width of the top of the dome can be less than that of the base of the dome. The ratio of the width of the top of the dome to the width of the base of the dome can be, for example, any of the following values or within any range having any of the following values as endpoints, though embodiments are not limited thereto: 0.20, 0.25, 0.30, 0.35, 0.40, 0.45, 0.46, 0.47, 0.48, 0.49, 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.75, 0.80, 0.85, 0.90, 0.95, about 0.20, about 0.25, about 0.30, about 0.35, about 0.40, about 0.45, about 0.46, about 0.47, about 0.48, about 0.49, about 0.50, about 0.51, about 0.52, about 0.53, about 0.54, about 0.55, about 0.56, about 0.57, about 0.58, about 0.59, about 0.60, about 0.61, about 0.62, about 0.63, about 0.64, about 0.65, about 0.66, about 0.67, about 0.68, about 0.69, about 0.70, about 0.75, about 0.80, about 0.85, about 0.90, about 0.95, less than 0.20, or greater than 0.95. For example, the ratio of the width of the top of the dome to the width of the base of the dome can be in a range of from 0.50 to 0.65 or from about 0.50 to about 0.65.

The thickness t of the dome can be, for example, any of the following values or within any range having any of the following values as endpoints, though embodiments are not limited thereto: 0.05 in, about 0.05 in, 0.1 in, about 0.1 in, 0.2 in, about 0.2 in, 0.3 in, about 0.3 in, 0.4 in, about 0.4 in, 0.5 in, about 0.5 in, 0.6 in, about 0.6 in, 0.7 in, about 0.7 in, 0.8 in, about 0.8 in, 0.9 in, about 0.9 in, 1.0 in, about 1.0 in, 1.1 in, about 1.1 in, 1.2 in, about 1.2 in, 1.3 in, about 1.3 in, 1.4 in, about 1.4 in, 1.5 in, about 1.5 in, 1.6 in, about 1.6 in, 1.7 in, about 1.7 in, 1.8 in, about 1.8 in, 1.9 in, about 1.9 in, 2.0 in, about 2.0 in, 2.1 in, about 2.1 in, 2.2 in, about 2.2 in, 2.3 in, about 2.3 in, 2.4 in, about 2.4 in, 2.5 in, about 2.5 in, 2.6 in, about 2.6 in, 2.7 in, about 2.7 in, 2.8 in, about 2.8 in, 2.9 in, about 2.9 in, 3.0 in, about 3.0 in, 3.1 in, about 3.1 in, 3.2 in, about 3.2 in, 3.3 in, about 3.3 in, 3.4 in, about 3.4 in, 3.5 in, about 3.5 in, 3.6 in, about 3.6 in, 3.7 in, about 3.7 in, 3.8 in, about 3.8 in, 3.9 in, about 3.9 in, 4.0 in, about 4.0 in, less than 0.05 in, or greater than 4.0 in. For example, the thickness t of the dome can be in a range of from 1.8 in to 2.2 in or from about 1.8 in to about 2.2 in. The thickness of the mat template can be the same as the thickness t of the dome and can also have any of the preceding values or be within any range having any of the preceding values as endpoints.

The distance e,g from the center point of an edge hole to the edge of the DWA (and, in some embodiments, the edge of the mat template) can be, for example, any of the following values or within any range having any of the following values as endpoints, though embodiments are not limited thereto: 0.1 in, about 0.1 in, 0.2 in, about 0.2 in, 0.3 in, about 0.3 in, 0.4 in, about 0.4 in, 0.5 in, about 0.5 in, 0.6 in, about 0.6 in, 0.7 in, about 0.7 in, 0.8 in, about 0.8 in, 0.9 in, about 0.9 in, 1.0 in, about 1.0 in, 1.1 in, about 1.1 in, 1.2 in, about 1.2 in, 1.3 in, about 1.3 in, 1.4 in, about 1.4 in, 1.5 in, about 1.5 in, 1.6 in, about 1.6 in, 1.7 in, about 1.7 in, 1.8 in, about 1.8 in, 1.9 in, about 1.9 in, 2.0 in, about 2.0 in, 2.1 in, about 2.1 in, 2.2 in, about 2.2 in, 2.3 in, about 2.3 in, 2.4 in, about 2.4 in, 2.5 in, about 2.5 in, 2.6 in, about 2.6 in, 2.7 in, about 2.7 in, 2.8 in, about 2.8 in, 2.9 in, about 2.9 in, 3.0 in, about 3.0 in, 3.1 in, about 3.1 in, 3.2 in, about 3.2 in, 3.3 in, about 3.3 in, 3.4 in, about 3.4 in, 3.5 in, about 3.5 in, 3.6 in, about 3.6 in, 3.7 in, about 3.7 in, 3.8 in, about 3.8 in, 3.9 in, about 3.9 in, 4.0 in, about 4.0 in, less than 0.1 in, less than 0.5 in, less than 1.0 in, less than 1.5 in, less than 2.0 in, less than about 2.0 in, less than 2.5 in, less than 3.0 in, less than 3.5 in, less than, 4.0 in, or greater than 4.0 in. For example, distance e,g from the center point of an edge hole to the edge of the DWA (and, in some embodiments, the edge of the mat template) can be less than 2.0 in or less than about 2.0 in. In an embodiment, the distances e and g can be the same.

As seen in FIGS. 1 and 7A, the distance a is equal to the distance f minus the diameter d, and the distance b is equal to the distance c minus the diameter d. The distances a,b can each be, for example, any of the following values or within any range having any of the following values as endpoints, though embodiments are not limited thereto: 0.2 in, about 0.2 in, 0.3 in, about 0.3 in, 0.4 in, about 0.4 in, 0.5 in, about 0.5 in, 0.6 in, about 0.6 in, 0.65 in, about 0.65 in, 0.7 in, about 0.7 in, 0.8 in, about 0.8 in, 0.9 in, about 0.9 in, 1.0 in, about 1.0 in, 1.1 in, about 1.1 in, 1.2 in, about 1.2 in, 1.3 in, about 1.3 in, 1.4 in, about 1.4 in, 1.5 in, about 1.5 in, 1.6 in, about 1.6 in, 1.7 in, about 1.7 in, 1.8 in, about 1.8 in, 1.9 in, about 1.9 in, 2.0 in, about 2.0 in, 2.1 in, about 2.1 in, 2.2 in, about 2.2 in, 2.3 in, about 2.3 in, 2.4 in, about 2.4 in, 2.5 in, about 2.5 in, 2.6 in, about 2.6 in, 2.7 in, about 2.7 in, 2.8 in, about 2.8 in, 2.9 in, about 2.9 in, 3.0 in, about 3.0 in, 3.1 in, about 3.1 in, 3.2 in, about 3.2 in, 3.3 in, about 3.3 in, 3.4 in, about 3.4 in, 3.5 in, about 3.5 in, 3.6 in, about 3.6 in, 3.7 in, about 3.7 in, 3.8 in, about 3.8 in, 3.9 in, about 3.9 in, 4.0 in, about 4.0 in, less than 0.2 in, at least 0.2 in, no more than 1.5 in, at least 0.65 in, or greater than 4.0 in. For example, the distance a,b between adjacent holes can each be at least 0.65 in, in a range of from 0.65 in to 1.5 in, or no more than 1.5 in. In an embodiment, the distances a and b can be the same.

Figure 2:
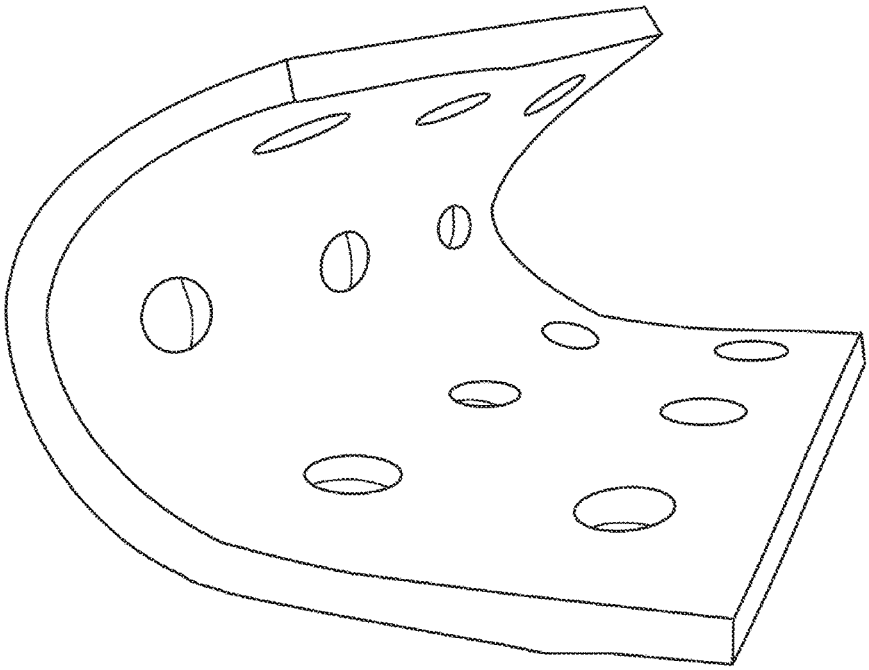
FIG. 2 shows an image of a flexing mat template according to an embodiment of the subject invention.

In an embodiment, the mat template can be flexible and can be formed of, for example, foam or a foam material, though embodiments are not limited thereto. FIG. 2 shows a flexing mat template. Referring to FIG. 2, the mat template can be configured such that it can easily flex length-wise or width-wise all the way around. That is, the mat template can be rolled into a cylinder shape without any breaking or cracking of the mat template. The mat template can also be deformable when pressure is applied. That is, if a portion of the mat template is pressed down by, for example, a person's finger, the mat template can have a depression, and the mat template can retake its original shape after the applied pressure is removed. The flexible nature of the mat template, especially in combination with the use of a squeegee, can advantageously allow the dome-forming material to be pushed down into and fill the holes of the mat template.

In an embodiment, the mat template can be disposable, such that each time a DWA is formed, a new mat template is used. Use of a fresh mat template can advantageously help ensure straight lines and clean domes.

The substrate can be formed of any suitable material. In an embodiment, the substrate is a gelcoat substrate. In an embodiment, the gelcoat substrate can include propylene glycol, neopentyl glycol, styrene monomer (e.g., UN number 2055), maleic anhydride, isopthalic acid, methyl methacrylate, barium sulfate, cobalt napthanate, quartz, hydroquinone, titanium dioxide ($TiO_2$), one or more pigments, and/or 2-(2-hydroxy-3,5-di-tert-amylphenyl)benzotriazole. In a particular embodiment, the gelcoat substrate can be resin available from Kelken Construction Systems, Sayreville, N.J. 08872 (hereinafter "Kelken"), such as 13959 resin, and can include propylene glycol, neopentyl glycol, styrene monomer, maleic anhydride, isopthalic acid, methyl methacrylate, barium sulfate, cobalt napthanate, quartz, hydroquinone, $TiO_2$, 2-(2-hydroxy-3,5-di-tert-amylphenyl)benzotriazole, and, optionally, one or more pigments. The gelcoat substrate advantageously provides good contact with the dome-forming material.

Once the gelcoat substrate is applied, it can be allowed to dry. The amount of time the substrate can be allowed to dry can be, for example, any of the following values or within any range having any of the following values as endpoints, though embodiments are not limited thereto: 0.25 min, about 0.25 min, 0.5 min, about 0.5 min, 0.75 min, about 0.75 min, 1 min, about 1 min, 2 min, about 2 min, 3 min, about 3 min, 3.5 min, about 3.5 min, 4 min, about 4 min, 4.5 min, about 4.5 min, 5 min, about 5 min, 5.5 min, about 5.5 min, 6 min, about 6 min, 6.5 min, about 6.5 min, 7 min, about 7 min, 8 min, about 8 min, 9 min, about 9 min, 10 min, about 10 min, 11 min, about 11 min, 12 min, about 12 min, 13 min, about 13 min, 14 min, about 14 min, 15 min, about 15 min, 16 min, about 16 min, 17 min, about 17 min, 18 min, about 18 min, 19 min, about 19 min, 20 min, about 20 min, 21 min, about 21 min, 22 min, about 22 min, 23 min, about 23 min, 24 min, about 24 min, 25 min, about 25 min, 26 min, about 26 min, 27 min, about 27 min, 28 min, about 28 min, 29 min, about 29 min, 30 min, about 30 min, or greater than 30 min. For example, the amount of time the substrate can be allowed to dry can be in the range of from 1 min to 5 min, from 4 min to 5 min, from 4 min to 6 min, from about 1 min to about 5 min, from about 1 min to about 6 min, from about 4 min to about 5 min, or from about 4 min to about 6 min.

The dome-forming material can be any suitable material. In several embodiments, the dome-forming material is an acrylic material, such as a modified acrylic. In an embodiment, the dome-forming material can include methyl methacrylate. In a further embodiment, the dome-forming material can include methyl methacrylate, a wax solution, and/or a resin solution. In a particular embodiment, the dome-forming material can be an asphalt sealer available from Kelken, such as 55-15-1 asphalt sealer, and can include methyl methacrylate, a wax solution, and 390 MTX cut resin solution. The dome-forming material advantageously provides good contact with the gelcoat substrate. In an embodiment, the dome-forming material material, once cured, can be removed by applying a lacquer thinner material.

In a particular embodiment, the substrate can include propylene glycol, neopentyl glycol, styrene monomer, maleic anhydride, isopthalic acid, methyl methacrylate, barium sulfate, cobalt napthanate, quartz, hydroquinone, $TiO_2$, and 2-(2-hydroxy-3,5-di-tert-amylphenyl)benzotriazole, and the dome-forming material can include methyl methacrylate, a wax solution, and a resin solution. The use of such a substrate and such a dome-forming material advantageously leads to exceptional contact between the substrate and the dome-forming material.

In an embodiment, a catalyst can be mixed with the dome-forming material prior to filling the mat template with the dome-forming material. The catalyst can be, for example, a peroxide, such as an organic peroxide. In an embodiment, the catalyst can include dibenzoyl peroxide and/or dicyclohexyl phthalate. For example, the catalyst can include dicyclohexyl phthalate in a range of 40% to 55% (w/w) and dibenzoyl peroxide in a range of 49% to 51% (w/w). In a particular embodiment, the catalyst can be Perkadox CH-50, available from Akzo Nobel Polymer Chemicals LLC, Chicago, Ill. 60607, which includes dibenzoyl peroxide and dicyclohexyl phthalate, and whose chemical description is "dibenzoyl peroxide, powder, 50% with dicyclohexyl phthalate." Perkadox CH-50 is a white powder with faint odor and can contain from 40% to 55% (w/w) of dicyclohexyl phthalate (CAS-number 000084-61-7) and from 49% to 51% (w/w) of dibenzoyl peroxide (CAS-number 000094-36-0).

In an embodiment, a catalyst can be mixed with the substrate material prior to forming the substrate. The catalyst can be, for example, a peroxide, such as an organic peroxide. In an embodiment, the catalyst can include dibenzoyl peroxide and/or dicyclohexyl phthalate. For example, the catalyst can include dicyclohexyl phthalate in a range of 40% to 55% (w/w) and dibenzoyl peroxide in a range of 49% to 51% (w/w). In a particular embodiment, the catalyst can be Perkadox CH-50.

In an embodiment, a reducing agent can be mixed with the dome-forming material prior to filling the mat template with the dome-forming material. The reducing agent can lower the viscosity of the dome-forming material and result in a less rough surface of the resulting dome, and the amount added (if any) can, in certain embodiments, be dependent upon the weather conditions (e.g., humidity and temperature). In an embodiment, the reducing agent can include hydroquinone. In a further embodiment, the reducing agent can include hydroquinone, tert-butyl catchetol, styrene monomer (UN 2055), and/or a solvent solution. In a particular embodiment, the reducing agent can be a reducer available from Kelken, such as 13957 reducer, and can include hydroquinone, styrene monomer (UN 2055), tert butyl catchetol, and a solvent solution.

In an embodiment, a colorant can be mixed with the dome-forming material prior to filling the mat template with the dome-forming material in order to provide a finished dome of a desired color. The colorant can be, for example, black, white, green, blue, yellow, red, brick red, or dark gray, though embodiments are not limited thereto.

In an embodiment, glass beads or other additives can be mixed with the dome-forming material prior to filling the mat template with the dome-forming material. These additives can increase the roughness, and in many cases the friction, of the resulting dome.

In certain embodiments, one or more of the following can be mixed with the dome-forming material prior to filling the mat template with the dome-forming material: catalyst, colorant, reducing agent, glass beads, and other roughness-increasing additives.

Figure 3:
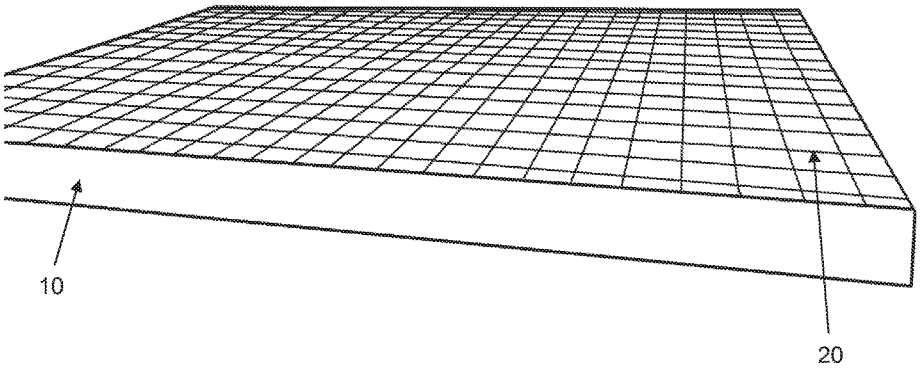
FIG. 3 shows a side view image of a panel for forming truncated domes according to an embodiment of the subject invention.
Figure 4:
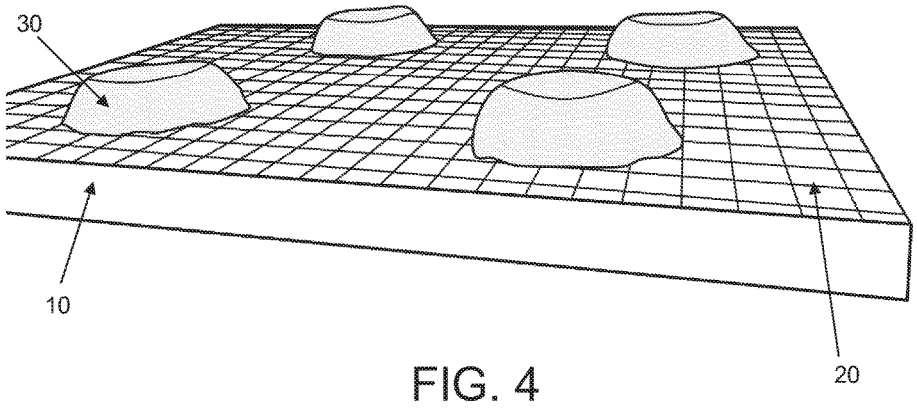
FIG. 4 shows a side view image of a panel of truncated domes formed according to an embodiment of the subject invention.

FIG. 3 shows a side view image of a substrate. Referring to FIG. 3, in an embodiment, a screen 20 can be placed over and directly on the substrate 10 before placing the mat template over the substrate. For example, the screen 20 can be rolled onto the substrate 10 while the substrate 10 is still wet or tacky (i.e., before the substrate has dried). Referring to FIG. 4, the screen 20 can therefore be present between at least a portion of the substrate 10 and the domes 30. In the event that the substrate 10 begins to crack or disintegrate due to use, the screen 20 can advantageously hold the DWA together. The screen 20 can be made of any suitable material. For example, the screen 20 can be a membrane made of fiberglass screening, though embodiments are not limited thereto.

Figure 5:
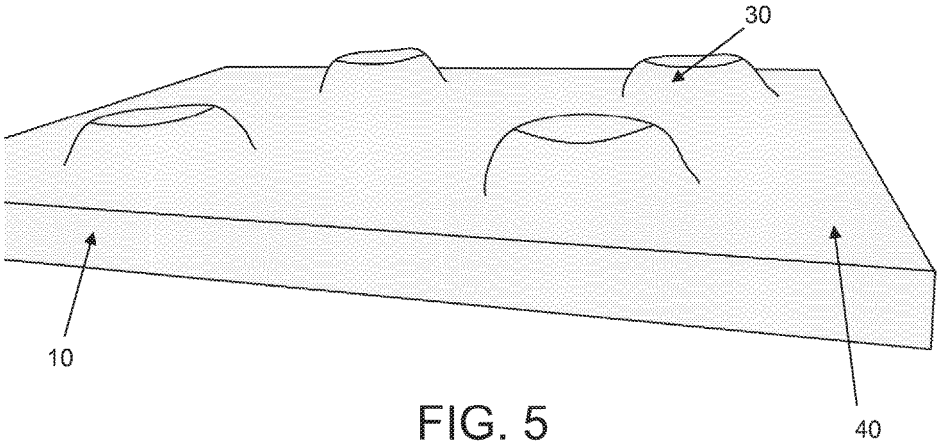
FIG. 5 shows a side view image of a panel of truncated domes formed according to an embodiment of the subject invention.

In an embodiment, the method of forming a DWA can further include pouring a top coat of dome-forming material over the already-formed domes after removing the mat template. The top coat can be applied by, for example, using a paint roller, using a paint brush, or pouring the dome-forming material over the domes, though embodiments are not limited thereto. FIG. 5 shows a side view image including a top coat 40 over the substrate 10. In an embodiment, the material for the top coat can be the same as that for the dome-forming material used to form the domes, including any catalyst, colorant, reducing agent, glass beads, and/or other additives that may have been added to the dome-forming material used to form the domes, though the proportions of catalyst, colorant, reducing agent, glass beads, and/or other additives may not necessarily be that same as for the dome-forming material used to form the domes. In a further embodiment, the material for the top coat can be the same as that for the dome-forming material used to form the domes, and the proportions of any catalyst, colorant, reducing agent, glass beads, and/or other additives present can be the same as for the dome-forming material used to form the domes. In a particular embodiment, a catalyst can be mixed with the dome-forming material for the top coat prior to pouring the top coat. The catalyst can be, for example, a peroxide, such as an organic peroxide. In an embodiment, the catalyst can include dibenzoyl peroxide and/or dicyclohexyl phthalate. For example, the catalyst can include dicyclohexyl phthalate in a range of 40% to 55% (w/w) and dibenzoyl peroxide in a range of 49% to 51% (w/w). In a particular embodiment, the catalyst can be Perkadox CH-50.

In several embodiments, a DWA can be formed in place right on the final location, which may, for example, concrete, asphalt, brick, stone, a raised or previously-stamped surface, or a Chattahoochee surface, though embodiments are not limited thereto. That is, the DWA can be a "cast in place" DWA formed through a "cast in place" method. In an embodiment, measurements can be made before forming the substrate. Tape or other markers can be placed on the target surface to show the desired shape of the DWA. A mat template may be placed after forming a substrate on a concrete surface. Dome forming material may be filled into the mat template using a squeegee with a rubber flat portion to ensure that the dome-forming material is pushed into the holes of the foam mat template. The mat template can be removed after the dome-forming material has completely cured. In an embodiment, one or more domes can be checked to ensure that curing is complete before removing the mat template. A top coat of dome-forming material may be applied using a paint roller, and the finished DWA may include a top coat in a flat shape along a sidewalk. DWAs made according to the subject invention can have any desired shape. The finished DWA may form a curved shape along a curb.

In an embodiment, a DWA is formed by one of the methods described herein and has structural differences over DWAs formed by existing methods. A DWA formed by a method according to the subject invention can have a dry coefficient of slip resistance of greater than 0.81 and a wet coefficient of slip resistance of greater than 0.65. A DWA formed by a method according to the subject invention can have a water absorption of less than 1%, a bond strength of greater than 250 pounds per square inch (psi), and a wear depth after 1000 cycles of less than 0.030 in.

For example, a DWA can be formed by forming a gelcoat substrate, providing a flexible mat template having one or more holes on the substrate, filling in the mat template by pouring an acrylic-based dome-forming material onto the mat substrate and working it into the holes of the mat template using a squeegee, allowing the dome-forming material to completely cure within the mat template, and then removing the mat template. Table 1 summarizes the values obtained in a test of a DWA formed by such a method, and Table 2 summarizes the values obtained in the same test of a DWA formed by existing methods. The DWA that was tested to give the results in Table 2 was formed by using an epoxy-based dome material in a relatively rigid, re-usable template made of hard rubber, in which the dome material was applied to the template using a squeeze bottle; the template was then removed almost immediately and the dome material was allowed to cure after the template was removed. As shown in Tables 1 and 2, a DWA formed by the method of the subject invention has structural differences over DWAs formed by existing methods. Such a DWA can have a dry coefficient of slip resistance of 0.96 or about 0.96, a wet coefficient of slip resistance of 0.71 or about 0.71, a water absorption of no more than 0.77% or no more than about 0.77%, a bond strength of 908.9 psi or about 908.9 psi, and a wear depth after 1000 cycles of 0.026 in or about 0.026 in. The bond strength is more than 260% greater than that of DWAs formed by existing methods, which is very advantageous for the long-term stability and reliability of the DWA. The dry coefficient of slip resistance is more than 18% higher than that of DWAs formed by existing methods, and the water absorption is >25% less than that of DWAs formed by existing methods. The details of the testing methods are presented in detail in Example 1 below.

TABLE 1

Test Results for DWA Formed by Method of Subject Invention

| Property | FDOT Requirement | Result | Status |
|---|---|---|---|
| Slip Resistance | Dry Coefficient = 0.80<br>Wet Coefficient = 0.65 | Dry = 0.96<br>Wet = 0.71 | Meets Requirement |
| Wear Resistance | Wear Depth ≤0.030" after 1000 cycles | Average = 0.026"<br>Maximum = 0.045" | Meets Requirement |
| Water Absorption | ≤5% | ≤0.77% | Meets Requirement |
| Bond Strength[1] | ≥50 psi | 908.9 psi | Meets Requirement |
| Light Reflectance Values (Y Value) | Safety Yellow = 25-45 | 43.177 | Meets Requirement |
| | Brick Red = 5-15 | 11.273 | Meets Requirement |
| | Black = 0-5 | 4.589 | Meets Requirement |

TABLE 2

Test Results for DWA Formed by Existing Methods

| Property | Requirement | Result |
|---|---|---|
| Slip Resistance | Dry Coefficient ≥0.80<br>Wet Coefficient ≥0.65 | Dry = 0.81<br>Wet = 0.74 |
| Wear Resistance | Wear Depth ≤0.030* after 1000 cycles | Average = 0.012<br>Maximum = 0.028 |
| Water Absorption | ≤5% | ≤1.04% |
| Bond Strength[1] | ≥50 psi | 250 psi |
| Xenon Arc Resistance/Color | Maintain 70% Contrast (ASTM D 1148) | 99% Retention |

The test results presented in Tables 1 and 2 are surprising, particularly the bond strength, dry coefficient of slip resistance, and water absorption. Before performing the tests, it was expected that the bond strength, dry coefficient of slip resistance, and water absorption would be comparable with those obtained using existing methods for forming a DWA. Instead, the bond strength is >260% greater, the dry coefficient of slip resistance is >18% higher, and the water absorption is >25% less than that of DWAs formed by existing methods. These improvements are both significant and advantageous.

The dry coefficient of slip resistance of a DWA according to the subject invention can be any of the following values or within any range having any of the following values as endpoints, though embodiments are not limited thereto: 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99, about 0.80, about 0.81, about 0.82, about 0.83, about 0.84, about 0.85, about 0.86, about 0.87, about 0.88, about 0.89, about 0.90, about 0.91, about 0.92, about 0.93, about 0.94, about 0.95, about 0.96, about 0.97, about 0.98, about 0.99, at least 0.80, at least 0.81, at least 0.82, at least 0.83, at least 0.84, at least 0.85, at least 0.86, at least 0.87, at least 0.88, at least 0.89, at least 0.90, at least 0.91, at least 0.92, at least 0.93, at least 0.94, at least 0.95, at least 0.96, at least 0.97, at least 0.98, at least 0.99, at least about 0.80, at least about 0.81, at least about 0.82, at least about 0.83, at least about 0.84, at least about 0.85, at least about 0.86, at least about 0.87, at least about 0.88, at least about 0.89, at least about 0.90, at least about 0.91, at least about 0.92, at least about 0.93, at least about 0.94, at least about 0.95, at least about 0.96, at least about 0.97, at least about 0.98, or at least about 0.99.

The wet coefficient of slip resistance of a DWA according to the subject invention can be any of the following values or within any range having any of the following values as endpoints, though embodiments are not limited thereto: 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.94, 0.95, 0.96, 0.97, 0.98, 0.99, about 0.65, about 0.66, about 0.67, about 0.68, about 0.69, about 0.70, about 0.71, about 0.72, about 0.73, about 0.74, about 0.75, about 0.76, about 0.77, about 0.78, about 0.79, about 0.80, about 0.81, about 0.82, about 0.83, about 0.84, about 0.85, about 0.86, about 0.87, about 0.88, about 0.89, about 0.90, about 0.94, about 0.95, about 0.96, about 0.97, about 0.98, about 0.99, at least 0.65, at least 0.66, at least 0.67, at least 0.68, at least 0.69, at least 0.70, at least 0.71, at least 0.72, at least 0.73, at least 0.74, at least 0.75, at least 0.76, at least 0.77, at least 0.78, at least 0.79, at least 0.80, at least 0.81, at least 0.82, at least 0.83, at least 0.84, at least 0.85, at least 0.86, at least 0.87, at least 0.88, at least 0.89, at least 0.90, at least 0.94, at least 0.95, at least 0.96, at least 0.97, at least 0.98, at least 0.99, at least about 0.65, at least about 0.66, at least about 0.67, at least about 0.68, at least about 0.69, at least about 0.70, at least about 0.71, at least about 0.72, at least about 0.73, at least about 0.74, at least about 0.75, at least about 0.76, at least about 0.77, at least about 0.78, at least about 0.79, at least about 0.80, at least about 0.81, at least about 0.82, at least about 0.83, at least about 0.84, at least about 0.85, at least about 0.86, at least about 0.87, at least about 0.88, at least about 0.89, at least about 0.90, at least about 0.94, at least about 0.95, at least about 0.96, at least about 0.97, at least about 0.98, or at least about 0.99.

The water absorption of a DWA according to the subject invention can be less than or equal to any of the following values, though embodiments are not limited thereto: 5%, 4%, 3%, 2%, 1%, 0.80%, 0.77%, 0.7%, 0.6%, 0.5%, about 5%, about 4%, about 3%, about 2%, about 1%, about 0.80%, about 0.77%, about 0.7%, about 0.6%, or about 0.5%.

The bond strength of a DWA according to the subject invention can be any of the following values or within any range having any of the following values as endpoints, though embodiments are not limited thereto: 50 psi, 100 psi, 150 psi, 200 psi, 250 psi, 251 psi, 300 psi, 350 psi, 400 psi, 450 psi, 500 psi, 600 psi, 700 psi, 800 psi, 900 psi, 908.9 psi, 950 psi, 1000 psi, about 50 psi, about 100 psi, about 150 psi, about 200 psi, about 250 psi, about 251 psi, about 300 psi, about 350 psi, about 400 psi, about 450 psi, about 500 psi, about 600 psi, about 700 psi, about 800 psi, about 900 psi, about 908.9 psi, about 950 psi, about 1000 psi at least 50 psi, at least 100 psi, at least 150 psi, at least 200 psi, at least 250 psi, at least 251 psi, at least 300 psi, at least 350 psi, at least 400 psi, at least 450 psi, at least 500 psi, at least 600 psi, at least 700 psi, at least 800 psi, at least 900 psi, at least 908.9 psi, at least 950 psi, at least 1000 psi at least about 50 psi, at least about 100 psi, at least about 150 psi, at least about 200 psi, at least about 250 psi, at least about 251 psi, at least about 300 psi, at least about 350 psi, at least about 400 psi, at least about 450 psi, at least about 500 psi, at least about 600 psi, at least about 700 psi, at least about 800 psi, at least about 900 psi, at least about 908.9 psi, at least about 950 psi, or at least about 1000 psi.

The wear depth after 1000 cycles of a DWA according to the subject invention can be less than or equal to any of the following values, though embodiments are not limited thereto: 0.045 in, 0.030 in, 0.029 in, 0.028 in, 0.027 in, 0.027 in, 0.026 in, 0.025 in, 0.024 in, 0.023 in, 0.022 in, 0.021 in, 0.020 in, 0.019 in, 0.018 in, 0.017 in, 0.016 in, 0.015 in, 0.014 in, 0.013 in, 0.012 in, 0.011 in, 0.010 in, about 0.045 in, about 0.030 in, about 0.029 in, about 0.028 in, about 0.027 in, about 0.027 in, about 0.026 in, about 0.025 in, about 0.024 in, about 0.023 in, about 0.022 in, about 0.021 in, about 0.020 in, about 0.019 in, about 0.018 in, about 0.017 in, about 0.016 in, about 0.015 in, about 0.014 in, about 0.013 in, about 0.012 in, about 0.011 in, about 0.010 in.

In an embodiment, a DWA according to the subject invention can be yellow (e.g., made by mixing a colorant with the dome-forming material to make it yellow) and can have a light reflectance value (Y value) in a range of, for example, from 25 to 45. In a particular embodiment, a DWA according to the subject invention can be yellow (e.g., made by mixing a yellow colorant with the dome-forming material) and can have a light reflectance value (Y value) of about 43 or of 43.177.

In an embodiment, a DWA according to the subject invention can be brick red (e.g., made by mixing a colorant with the dome-forming material to make it brick red) and can have a light reflectance value (Y value) in a range of, for example, from 5 to 15. In a particular embodiment, a DWA according to the subject invention can be brick red (e.g., made by mixing a brick red colorant with the dome-forming material) and can have a light reflectance value (Y value) of about 11 or of 11.273.

In an embodiment, a DWA according to the subject invention can be black (e.g., made by mixing a colorant with the dome-forming material to make it black) and can have a light reflectance value (Y value) in a range of, for example, from 0 to 5. In a particular embodiment, a DWA according to the subject invention can be yellow (e.g., made by mixing a yellow colorant with the dome-forming material) and can have a light reflectance value (Y value) of about 4.5 or of 4.589.

In an embodiment of the subject invention, a kit for forming a DWA can be provided. The kit can include at least one container of dome-forming material, such as acrylic dome-forming material. The kit can also include one or more of the following: at least one container of substrate material (e.g., gelcoat substrate material); at least one container of reducing agent; and at least one container of catalyst material. The reducing agent and the catalyst material can be as described herein. Each container can be, for example, a can or a packet, though embodiments are not limited thereto. In a further embodiment, the kit can also include one or more of the following items: at least one mat template; at least one squeegee; at least one container of colorant (e.g., colored base); at least one screen; a viscosity test template pack; and at least one container of roughness-increasing material, such as glass beads. The mat template, squeegee, and screen can be as described herein. Each mat template can be of any reasonable size, for example, 10 square feet or 100 square feet. In an embodiment, the dome-forming material can already include a colorant, such that the dome-forming material is colored and such that the at least one container of dome-forming material is a container of colored dome-forming material. If the dome-forming material is colored, a colorant may not be necessary in the kit, and the resulting DWA can still be of a desired color (e.g., yellow, red, green, blue, white, brick red, dark gray, or black, though embodiments are not limited thereto).

Various items that can be useful when forming a DWA according to the subject invention and which can be included in certain embodiments of a kit, include a paint roller (e.g., a roller with a 0.25-inch nap), a paint brush, tape, lacquer thinner, a bucket (e.g., a 2.5-quart bucket), gloves (e.g., latex gloves), a putty knife, a mixing wand, a bright construction-type vest, caution tape, a canvas (e.g., a 5-foot by 5-foot easy drop canvas), a paint odor respirator, and clean-up bags. Other items that can be useful when forming a DWA according to the subject invention and which can be included in certain embodiments of a kit include scissors, painter's tape, a tape measure, a cordless drill, and/or one or more rags.

In a particular embodiment, a kit can include: two cans of acrylic dome-forming material material; one can of gelcoat substrate material; one can of reducing material; and three packs of catalyst material. The three packs of catalyst material can be provided for, e.g., mixing with the gelocat substrate material prior to forming the substrate, mixing with the acrylic dome-forming material prior to forming the domes, and mixing with the acrylic dome-forming material prior to forming a top coat, though embodiments are not limited thereto. The acrylic dome-forming material can include a colorant such that the dome-forming material is colored dome-forming material material. In a further embodiment, the kit also includes at least one mat template as described herein. Such a kit advantageously provides enough material and in appropriate proportions to form a DWA. In a specific embodiment, each can of dome-forming material can be a 1-quart can, the can of reducing material can be a 0.5-pint can, the can of gelcoat substrate material can be a 1-pint can, and each pack of catalyst material can be a packet having a net weight of 1.5 ounces or about 1.5 ounces. The kit can include, for example, two mat templates, though embodiments are not limited thereto. In a further embodiment, the kit can include a viscosity testing template pack.

In an embodiment, the viscosity test packet can include a set of instructions detailing how to confirm what a finished dome will look like and how long it will take to form (i.e., how long the dome-forming material will take to cure). The viscosity test, if performed, can be done prior to placing the full mat template so that the user can determine proper formation time and establish correct mixture. The instructions instruct the user to mix the dome-forming material but not to add any catalyst, then a small sample size of the mat template can be filled with the dome-forming material. The user is then instructed to track the time prior to pulling the template so that the user can establish the correct time the material stays in the template until completely curing, for ideal formation. The viscosity testing template can also include tips and suggestions on how to improve the quality of the truncated dome if the user is having problems.

Exemplified Embodiments

The invention includes, but is not limited to, the following embodiments:

Embodiment 1

A method of forming a detectable warning area (DWA) comprising a plurality of domes, comprising:

forming a substrate;

placing a mat template on the substrate, wherein the mat template comprises a plurality of holes;

filling the mat template with a dome-forming material by pouring the dome-forming material over the mat template and working the dome-forming material into the plurality of holes of the mat template, wherein the dome-forming material is an acrylic-based dome-forming material;

allowing the dome-forming material to completely cure; and removing the mat template after the dome-forming material has completely cured, thereby forming the plurality of domes, each dome of the plurality of domes corresponding to a hole of the plurality of holes of the mat template.

Embodiment 2

The method according to embodiment 1, wherein working the dome-forming material into the plurality of holes of the mat template comprises using a squeegee to work the dome-forming material into the plurality of holes of the mat template.

Embodiment 3

The method according to any of embodiments 1-2, wherein the substrate comprises a gelcoat material.

Embodiment 4

The method according to any of embodiments 1-2, wherein the substrate comprises one or more materials selected from the following group: propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), one or more pigments, and 2-(2-hydroxy-3,5-di-tert-amylphenyl)benzotriazole.

Embodiment 5

The method according to any of embodiments 1-2, wherein the substrate comprises propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), and 2-(2-hydroxy-3,5-di-tert-amylphenyl)benzotriazole.

Embodiment 6

The method according to any of embodiments 1-5, further comprising mixing the dome-forming material with a catalyst before filling the mat template with the dome-forming material, wherein the catalyst comprises an organic peroxide.

Embodiment 7

The method according to embodiment 6, wherein the catalyst comprises one or more materials selected from the following group: dicyclohexyl phthalate and dibenzoyl peroxide.

Embodiment 8

The method according to embodiment 6, wherein the catalyst comprises dicyclohexyl phthalate and dibenzoyl peroxide.

Embodiment 9

The method according to embodiment 6, wherein the catalyst comprises dicyclohexyl phthalate present in a range of 40% to 55% (w/w) and dibenzoyl peroxide present in a range of 49% to 51% (w/w).

Embodiment 10

The method according to any of embodiments 1-9, further comprising mixing the dome-forming material, before filling the mat template with the dome-forming material, with one or more materials selected from the following group: a colorant, a reducing agent, and glass beads.

Embodiment 11

The method according to embodiment 10, wherein the reducing agent comprises one or more materials selected from the following group: hydroquinone, styrene monomer (UN 2055), tert butyl catchetol, and a solvent solution.

Embodiment 12

The method according to embodiment 10, wherein the reducing agent comprises hydroquinone, styrene monomer (UN 2055), tert butyl catchetol, and a solvent solution.

Embodiment 13

The method according to any of embodiments 1-12, wherein allowing the dome-forming material to completely cure comprises allowing the dome-forming material to cure for a period of time in a range of from about 4 minutes to about 6 minutes before removing the mat template.

Embodiment 14

The method according to any of embodiments 1-13, wherein each hole of the plurality of holes of the mat template has a circular cross-section.

Embodiment 15

The method according to any of embodiments 1-14, wherein the plurality of holes are arranged in an array such that outer holes of the array form a rectangular shape and such that holes of the plurality of holes along any axis that is parallel to a side of the rectangular shape are the same distance apart from each other (this arrangement can be seen in, e.g. FIGS. 1 and 7A), wherein a distance (c and fin FIG. 7A) between center points of adjacent holes of the plurality of holes, along any axis that is parallel to a side of the rectangular shape, is in a range of from 1.6 inches to 2.4 inches, wherein each hole of the plurality of holes has a diameter (d in FIG. 1) in a range of from 0.9 inches to 1.4 inches, wherein the mat template has a thickness in a range of from 0.18 inches to 0.22 inches, and wherein a distance (a and b in FIG. 1) between adjacent edges of adjacent holes of the plurality of holes, along any axis that is parallel to a side of the rectangular shape, is at least 0.65 10 inches.

Embodiment 16

The method according to any of embodiments 1-15, wherein forming the substrate comprises providing the substrate material in a desired shape and allowing the substrate material to dry, and wherein the method further comprises rolling a screen onto the substrate material before the substrate material dries.

Embodiment 17

The method according to embodiment 16, wherein the screen comprises a fiberglass material.

Embodiment 18

The method according to any of embodiments 1-17, wherein the dome-forming material comprises methyl methacrylate.

Embodiment 19

The method according to any of embodiments 1-17, wherein the dome-forming material comprises at least one material selected from the following group: methyl methacrylate, a wax solution, and a resin solution.

Embodiment 20

The method according to embodiment 18, wherein the dome-forming material further comprises a wax solution and a resin solution.

Embodiment 21

The method according to any of embodiments 1-20, further comprising forming a top coat of dome-forming material after removing the mat template.

Embodiment 22

The method according to embodiment 21, wherein forming the top coat of dome-forming material comprises applying the dome-forming material with a paint roller, a paint brush, or both, to the already-formed domes and the remainder of the DWA.

Embodiment 23

The method according to any of embodiments 1-22, wherein each dome of the plurality of domes is a truncated dome.

Embodiment 24

The method according to embodiment 23, wherein each truncated dome has a ratio of a width at its top to a width (win FIG. 7A) at its base in a range of from 0.50 to 0.65.

Embodiment 25

The method according to any of embodiments 23-24, wherein each truncated dome has a thickness (t in FIG. 7A) in a range of from 0.18 inches to 0.22 inches.

Embodiment 26

The method according to any of embodiments 1-25, wherein the mat template is a foam mat template.

Embodiment 27

A detectable warning area (DWA) formed by a method according to any of embodiments 1-26.

Embodiment 28

The DWA according to embodiment 27, wherein the DWA has a bond strength of at least 300 pounds per square inch.

Embodiment 29

The DWA according to any of embodiments 27-28, wherein the DWA has a dry coefficient of slip resistance of at least 0.85.

Embodiment 30

The DWA according to any of embodiments 27-29, wherein the DWA has a water absorption of less than or equal to 1.0%.

Embodiment 31

The DWA according to embodiment 27, wherein the DWA has a bond strength of at least 900 pounds per square inch, a dry coefficient of slip resistance of at least 0.90, and a water absorption of less than or equal to 0.8%.

Embodiment 32

A kit, comprising:
at least one container of acrylic-based dome-forming material;
at least one container of gelcoat substrate material;
at least one packet of peroxide catalyst; and
at least one mat template having a plurality of holes.

Embodiment 33

The kit according to embodiment 32, wherein the kit further comprises at least one container of reducing agent.

Embodiment 34

The kit according to any of embodiments 32-33, comprising:
two containers of acrylic-based dome-forming material;
one container of gelcoat substrate material;
three packets of peroxide catalyst; and
one container of reducing agent.

Embodiment 35

The kit according to any of embodiments 32-34, comprising two mat templates.

Embodiment 36

The kit according to any of embodiments 32-35, wherein each container of acrylic-based dome-forming material is a one-quart container.

Embodiment 37

The kit according to any of embodiments 32-36, wherein each container of gelcoat substrate material is a one-pint container.

Embodiment 38

The kit according to any of embodiments 33-37, wherein each container of reducing agent is a ½-pint container.

Embodiment 39

The kit according to any of embodiments 32-38, wherein each packet of peroxide catalyst has a net weight of about 1.5 ounces.

Embodiment 40

The kit according to any of embodiments 32-39, wherein the acrylic dome-forming material comprises methyl methacrylate.

Embodiment 41

The kit according to any of embodiments 32-39, wherein the dome-forming material comprises at least one material selected from the following group: methyl methacrylate, a wax solution, and a resin solution.

Embodiment 42

The kit according to embodiment 40, wherein the dome-forming material further comprises a wax solution and a resin solution.

Embodiment 43

The kit according to any of embodiments 32-42, wherein the substrate comprises a gelcoat material.

Embodiment 44

The kit according to any of embodiments 32-43, wherein the substrate comprises one or more materials selected from the following group: propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), one or more pigments, and 2-(2-hydroxy-3,5-di-tert-amylphenyl)benzotriazole.

Embodiment 45

The kit according to any of embodiments 32-43, wherein the substrate comprises propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), and 2-(2-hydroxy-3,5-di-tert-amylphenyl)benzotriazole.

Embodiment 46

The kit according to any of embodiments 32-45, wherein the peroxide catalyst comprises an organic peroxide.

Embodiment 47

The kit according to any embodiments 32-45, wherein the peroxide catalyst comprises one or more materials selected from the following group: dicyclohexyl phthalate and dibenzoyl peroxide.

Embodiment 48

The kit according to any embodiments 32-45, wherein the peroxide catalyst comprises dicyclohexyl phthalate and dibenzoyl peroxide.

Embodiment 49

The kit according to any embodiments 32-45, wherein the peroxide catalyst comprises dicyclohexyl phthalate present in a range of 40% to 55% (w/w) and dibenzoyl peroxide present in a range of 49% to 51% (w/w).

Embodiment 50

The kit according to any of embodiments 33-49, wherein the reducing agent comprises one or more materials selected from the following group: hydroquinone, styrene monomer (UN 2055), tert butyl catchetol, and a solvent solution.

Embodiment 51

The kit according to any of embodiments 33-49, wherein the reducing agent comprises hydroquinone, styrene monomer (UN 2055), tert butyl catchetol, and a solvent solution.

Embodiment 52

The kit according to any of embodiments 32-51, further comprising a viscosity test template pack.

Embodiment 53

The kit according to any of embodiments 32-52, wherein the mat template is a foam mat template.

All patents, patent applications, provisional applications, and publications referred to or cited herein are incorporated by reference in their entirety, including all figures and tables, to the extent they are not inconsistent with the explicit teachings of this specification.

EXAMPLES

Following are examples that illustrate procedures for practicing the invention. These examples should not be construed as limiting. All percentages are by weight and all solvent mixture proportions are by volume unless otherwise noted.

Example 1

A detectable warning coating was prepared and tested by Architectural Testing, Inc. (130 Derry Court, York, Pa., 17406-8405). A gelcoat substrate was formed, a flexible mat template having holes was provided on the substrate, the mat template was filled in by pouring an acrylic-based dome-forming material onto the mat substrate and working it into the holes of the mat template using a squeegee, the dome-forming material was allowed to completely cure within the mat template, and then the mat template was removed. The gelcoat substrate included propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), and 2-(2-hydroxy-3,5-di-tert-amylphenyl)benzotriazole. The acrylic-based dome-forming material included methyl methacrylate, a wax solution, and a resin solution. The dome-forming material was mixed with a catalyst before being poured onto the mat template; the catalyst was Perkadox CH-50, as described herein, which includes dibenzoyl peroxide and dicyclohexyl phthalate.

The detectable warning coating was tested and evaluated in accordance with the following test methods and requirements that are found in the Florida Department of Transportation (FDOT) Standard Specifications for Road and Bridge Construction—2010, Section 527, Detectable Warnings on Walking Surfaces, which is hereby incorporated by reference in its entirety: ASTM C 1028-07, Standard Test Method for Determining the Static Coefficient of Friction of Ceramic Tile and Other Like Surfaces by the Horizontal Dynamometer Pull-Meter Method; ASTM C 501-84 (2002), Standard Test Method for Relative Resistance to Wear of Unglazed Ceramic Tile by the Taber Abraser; ASTM D 570-98 (2005), Standard Test Method for Water Absorption of Plastics; and ASTM C 482-02, Standard Test Method for Bond Strength of Ceramic Tile to Portland Cement.

Table 1 above shows the average results of the tests performed, and Table 2 above shows the results for the same tests performed on a detectable warning coating formed by related art methods. All samples for the results presented in Table 1 and in Tables 3-16 below were prepared by Liquidomes, LLC and submitted directly to Architectural Testing.

The slip resistance evaluation was performed using a Chatillon Push/Pull Force Gage (ATI ICN 004695) and a calibrated 50 pound weight (ATI ICN Y00I080). Three 12-inch by 12-inch samples were tested in both dry and wet conditions. The materials were rotated in 90° increments to represent 0°, 90°, 180°, and 270° positions.

The wear resistance evaluation was performed utilizing a Taber Model 5130 Abraser (ATI ICN Y001522). Three 4-inch by 4-inch panels were tested. The height of each non-skid dome was measured before and after being subjected to 1000 cycles under a load of 1000 grams using H-22 Calibrase wheels.

The wear resistance evaluation was performed utilizing a Taber Model 5130 Abraser (ATI ICN Y001522). This setup is shown in FIG. 19. Three 4-inch by 4-inch panels were tested. The height of each non-skid dome was measured before and after being subjected to 1000 cycles under a load of 1000 grams using H-22 Calibrase wheels. FIG. 20 shows a panel after testing.

The water absorption evaluations were performed using three nominal 2-inch by 2-inch samples of the non-skid material. Seven different sets of conditions, including room temperature, elevated temperature, boiling, and long term immersion, were conducted.

The bond strength evaluation was performed using a SATEC Model 50UD universal test machine (ATI ICN Y002011). Five 6-inch by 6-inch by 2-inch thick concrete blocks having the non-skid surface and raised domes applied to them were tested. The samples were restrained on a long side to the base of the test equipment. A shear load parallel to the face of the sample was applied to the raised dome at a loading rate of 200 psi per minute until failure was observed.

The light reflectance specimens were evaluated in accordance with ASTM C 609-07, Standard Test Method for Measurement of Light Reflectance Value and Small Color Differences Between Pieces of Ceramic Tile. The detectable coatings were read on an X-rite Color i5 Spectrophotometer (ATI ICN 004725). The color equation used was CIE-L*a*b* (1976) with a 10° observer and the D65 (daylight) illuminant. Blocks of various colors—yellow, red, and black—were tested.

Calibration data is shown in Tables 3 and 4. The sled assembly weight (W) was 51.55 lbs, and a 3-inch Neolite pad was used, Force Gage 004695.

TABLE 3

Dry Calibration Results
Dry Calibration

| Pull # | Value (lbs) |
|---|---|
| 1 | 42 |
| 2 | 43 |
| 3 | 41 |
| 4 | 41 |
| Average ($R_D$) | 41.75 |
| $X_D$ | 0.0501 |

TABLE 4

Wet Calibration Results
Wet Calibration

| Pull # | Value (lbs) |
|---|---|
| 1 | 47 |
| 2 | 28 |
| 3 | 28 |
| 4 | 29 |
| Average ($R_W$) | 33.00 |
| $X_W$ | −0.1302 |

The calibration calculation equation for dry calibration is:

$$X_D=0.86-R_d/(NW) \quad (1)$$

The calibration calculation equation for dry calibration is:

$$X_w=0.51-R_w/(NW) \quad (2)$$

In Equations 1 and 2, R is the total value of the pulls conducted, N is the total number of pulls (i.e., 4), and W is the weight of the sled assembly (see Sections 7 and 9 in ASTM C 1028-07 for further detail). The subscripts D and W are for dry and wet, respectively. The equation for the coefficient of friction is:

$$F_D=\{R_D/(NW)\}+X_D \quad (3)$$

R is the total value of the pulls conducted, N is the total number of pulls (i.e., 12), W is the weight of the sled assembly, and X is the calibration adjustment factor (see Sections 8 and 10 in ASTM C 1028-07 for further detail). Test results for the coefficient of friction (ASTM C 1028) are shown in Table 5.

TABLE 5

Test Results for Coefficient of Friction
Sample No. 1

| Surface Condition | Sample Number | Pull Orientation | Value (lbs) |
|---|---|---|---|
| Dry | 1 | 0° | 46 |
| | | 90° | 48 |
| | | 180° | 46 |
| | | 270° | 47 |
| | 2 | 0° | 43 |
| | | 90° | 47 |
| | | 180° | 49 |
| | | 270° | 47 |
| | 3 | 0° | 49 |
| | | 90° | 45 |
| | | 180° | 49 |
| | | 270° | 47 |
| | Average ($R_D$) | | 47 |
| | Coefficient of Friction ($F_D$) | | 0.96 |
| Wet[1] | 1 | 0° | 43 |
| | | 90° | 44 |
| | | 180° | 44 |
| | | 270° | 45 |
| | 2 | 0° | 41 |
| | | 90° | 44 |
| | | 180° | 44 |
| | | 270° | 41 |
| | 3 | 0° | 43 |
| | | 90° | 43 |
| | | 180° | 42 |
| | | 270° | 43 |
| | Average ($R_W$) | | 43 |
| | Coefficient of Friction ($F_W$) | | 0.71 |

Test results for wear resistance (ASTM C 501) are shown in Table 6.

TABLE 6

Test Results for Wear Resistance

| Sample No. 1 | Pre-Cycling Thickness (in) | Post-Cycling Thickness (in) | Change (in) |
|---|---|---|---|
| a | 0.364 | 0.337 | 0.027 |
| b | 0.367 | 0.338 | 0.029 |
| c | 0.349 | 0.335 | 0.014 |
| d | 0.331 | 0.304 | 0.027 |
| | Average | | 0.024 |
| a | 0.346 | 0.323 | 0.023 |
| b | 0.346 | 0.317 | 0.029 |
| c | 0.368 | 0.323 | 0.045 |
| d | 0.355 | 0.322 | 0.033 |
| | Average | | 0.033 |
| a | 0.343 | 0.318 | 0.025 |
| b | 0.337 | 0.316 | 0.021 |
| c | 0.355 | 0.339 | 0.016 |
| d | 0.343 | 0.318 | 0.025 |
| | Average | | 0.022 |

Test results for water absorption (ASTM D 570) are shown in Tables 7-14.

TABLE 7

Water Absorption for Twenty-Four Hour Continuation Immersion

| Sample No. | Pre-Immersion Weight (g) | Post-Immersion Weight (g) | Change (%) |
|---|---|---|---|
| 1 | 16.0645 | 16.1081 | 0.27 |
| 2 | 15.5655 | 15.6077 | 0.27 |
| 3 | 16.0293 | 16.0595 | 0.19 |
| | | | 0.24 |

TABLE 8

| Water Absorption for Two Hour Immersion | | | |
|---|---|---|---|
| Sample No. | Pre-Immersion Weight (g) | Post-Immersion Weight (g) | Change (%) |
| 1 | 15.5951 | 15.6116 | 0.11 |
| 2 | 15.2721 | 15.2877 | 0.10 |
| 3 | 15.9215 | 15.9440 | 0.14 |
| | Average | | 0.12 |

TABLE 9

| Water Absorption for Twenty-Two Hour Repeated Immersion Post Two Hour Immersion) | | | |
|---|---|---|---|
| Sample No. | Pre-Immersion Weight (g) | Post-Immersion Weight (g) | Change (%) |
| 1 | 15.5951 | 15.6339 | 0.25 |
| 2 | 15.2721 | 15.3067 | 0.23 |
| 3 | 15.9215 | 15.9708 | 0.31 |
| | Average | | 0.26 |

TABLE 10

| Water Absorption for Long Term Immersion | | | |
|---|---|---|---|
| Sample No. | Pre-Immersion Weight (g) | Post-Immersion Weight (g) | Change (%) |
| 1 | 16.0645 | 16.1333 | 0.43 |
| 2 | 15.5655 | 15.6317 | 0.43 |
| 3 | 16.0293 | 16.0976 | 0.43 |
| | Average | | 0.43 |

TABLE 11

| Water Absorption for Long Term Immersion | | | |
|---|---|---|---|
| Post-Immersion Weight (g) | 2 Week Change (%) | Post-Immersion Weight (g) | 3 Week Change (%) |
| 16.1852 | 0.75 | 16.1862 | 0.76 |
| 15.6707 | 0.68 | 15.6859 | 0.77 |
| 16.1352 | 0.66 | 16.1552 | 0.79 |
| Average | 0.70 | Average | 0.77 |

TABLE 12

| Water Absorption for Two Hour Boiling Water Immersion | | | |
|---|---|---|---|
| Sample No. | Pre-Immersion Weight (g) | Post-Immersion Weight (g) | Change (%) |
| 1 | 15.8814 | 15.9562 | 0.47 |
| 2 | 15.5145 | 15.5889 | 0.48 |
| 3 | 15.6017 | 15.6746 | 0.47 |
| | Average | | 0.47 |

TABLE 13

| Water Absorption for Thirty Minute Boiling Water Immersion | | | |
|---|---|---|---|
| Sample No. | Pre-Immersion Weight (g) | Post-Immersion Weight (g) | Change (%) |
| 1 | 15.7199 | 15.7501 | 0.19 |
| 2 | 15.8171 | 15.8500 | 0.21 |
| 3 | 15.7963 | 15.8261 | 0.19 |
| | Average | | 0.20 |

TABLE 14

| Water Absorption for Forty-Eight Hours at 50° C. Water Immersion | | | |
|---|---|---|---|
| Sample No. | Pre-Immersion Weight (g) | Post-Immersion Weight (g) | Change (%) |
| 1 | 15.1388 | 15.2446 | 0.70 |
| 2 | 17.0736 | 17.2171 | 0.84 |
| 3 | 15.7080 | 15.8275 | 0.76 |
| | Average | | 0.77 |

Test results for bond strength (ASTM C 482) are shown in Table 15.

TABLE 15

| Test Results for Bond Strength | | | |
|---|---|---|---|
| Sample No. | Peak Load (lbf) | Raised Dome Surface Area ($in^2$) | Bond Strength (psi) |
| 1 | 464.6 | 0.534 | 870.0 |
| 2 | 410.9 | 0.555 | 740.4 |
| 3 | 502.1 | 0.544 | 922.9 |
| 4 | 546.9 | 0.538 | 1016.5 |
| 5 | 470.4 | 0.473 | 994.5 |
| | Average | | 908.9 |

Test results for light reflectance values (ASTM C 609) are shown in Table 16.

TABLE 16

| Test Results for Light Reflectance Values | |
|---|---|
| Sample Color | Y Value |
| Safety Yellow | 43.177 |
| Brick Red | 11.273 |
| Black | 4.589 |

It should be understood that the examples and embodiments described herein are for illustrative purposes only and that various modifications or changes in light thereof will be suggested to persons skilled in the art and are to be included within the spirit and purview of this application. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A method of forming a detectable warning area (DWA) comprising a plurality of domes, comprising:

forming a substrate;

placing a mat template on the substrate, wherein the mat template comprises a plurality of openings;

mixing a dome-forming material with a catalyst filling the mat template with the dome-forming material mixed with the catalyst by pouring the dome-forming material over the mat template and working the dome-forming material into the plurality of openings of the mat template, wherein the dome-forming material is an acrylic-based dome-forming material;

allowing the dome-forming material mixed with the catalyst to cure for a period of time in a range of from about 4 minutes to about 6 minutes; and removing the mat template after the dome-forming material has cured for the period of time in the range of from about 4 minutes to about 6 minutes, thereby forming the plurality of domes, each dome of the plurality of domes corresponding to an opening of the plurality of openings of the mat template, wherein the catalyst comprises dicyclohexyl phthalate present in a range of 40% to 55% (w/w) of the catalyst and dibenzoyl peroxide present in a range of 49% to 51% (w/w) of the catalyst.

2. The method according to claim 1, wherein working the dome-forming material into the plurality of openings of the mat template comprises using a squeegee to work the dome-forming material into the plurality of openings of the mat template.

3. The method according to claim 1, wherein the substrate comprises propylene glycol, neopentyl glycol, styrene monomer, maleic anhydride, isopthalic acid, methyl methacrylate, barium sulfate, cobalt napthanate, quartz, hydroquinone, titanium dioxide ($TiO_2$), or 2-(2-hydroxy-3,5-di-tert-amylphenyl)benzotriazole.

4. The method according to claim 1, further comprising mixing the dome-forming material, before filling the mat template with the dome-forming material, with a colorant, a reducing agent, and glass beads, wherein the reducing agent comprises hydroquinone, styrene monomer (UN number 2055), tert butyl catchetol, and a solvent solution.

5. The method according to claim 1, wherein each opening of the plurality of openings of the mat template has a circular cross-section, and wherein the mat template is foam.

6. The method according to claim 5, wherein the plurality of holes are arranged in an array such that outer holes openings of the array form a rectangular shape and such that holes of the plurality of openings along any axis that is parallel to a side of the rectangular shape are the same distance apart from each other, wherein a distance between center points of adjacent holes of the plurality of holes, along any axis that is parallel to a side of the rectangular shape, is in a range of from 1.6 inches to 2.4 inches, wherein each hole of the plurality of openings has a diameter in a range of from 0.9 inches to 1.4 inches, wherein the mat template has a thickness in a range of from 0.18 inches to 0.22 inches, and wherein a distance between adjacent edges of adjacent holes of the plurality of holes, along any axis that is parallel to a side of the rectangular shape, is at least 0.65 inches.

7. The method according to claim 1, wherein forming the substrate comprises providing the substrate material in a desired shape and allowing the substrate material to dry, and wherein the method further comprises rolling a screen onto the substrate material before the substrate material dries.

8. The method according to claim 7, wherein the screen comprises a fiberglass material.

9. The method according to claim 1, wherein the dome-forming material comprises methyl methacrylate, a wax solution, and a resin solution.

10. The method according to claim 1, further comprising forming a top coat of dome-forming material after removing the mat template.

11. The method according to claim 10, wherein forming the top coat of dome-forming material comprises applying the dome-forming material with a paint roller, a paint brush, or both, to the already-formed domes and the remainder of the DWA.

12. The method according to claim 10, wherein each dome of the plurality of domes is a truncated dome, and wherein each truncated dome has a ratio of a width at its top to a width at its base in a range of from 0.50 to 0.65.

13. The method according to claim 1, wherein each dome of the plurality of domes is a truncated dome, wherein each truncated dome has a ratio of a width at its top to a width at its base in a range of from 0.50 to 0.65 and wherein each truncated dome has a thickness in a range of from 0.18 inches to 0.22 inches.

14. A detectable warning area (DWA) formed by the method according to claim 1.

15. The DWA according to claim 14, wherein the DWA has a bond strength of at least 900 pounds per square inch, a dry coefficient of slip resistance of at least 0.90, and a water absorption of less than or equal to 0.8%.

16. The method according to claim 1, wherein a distance between center points of adjacent openings of the plurality of openings, along an axis that is perpendicular to an edge of the mat template, is about 2 to 3 inches, and wherein a distance between the edge and a center point of an opening openings that is closest to the edge along the axis that is perpendicular to the edge is about 1 to 1.5 inches.

17. The method according to claim 16, wherein the distance between center points of adjacent openings of the plurality of openings, along the axis that is perpendicular to the edge of the mat template, is about 2.2 inches, and wherein the distance between the edge and the center point of the opening that is closest to the edge along the axis that is perpendicular to the edge is about 1.1 inches.

* * * * *